United States Patent [19]

Satake et al.

[11] Patent Number: 4,628,336

[45] Date of Patent: Dec. 9, 1986

[54] THERMOSENSITIVE RECORDING SHEET

[75] Inventors: Toshimi Satake; Toshiaki Minami; Fumio Fujimura, all of Tokyo; Satoshi Oda; Masato Magami, both of Nakatsu, all of Japan

[73] Assignees: Jujo Paper Co., Ltd., Tokyo; Yoshitomi Pharmaceutical Industries Ltd., Osaka, both of Japan

[21] Appl. No.: 753,905

[22] Filed: Jul. 11, 1985

[30] Foreign Application Priority Data

Jul. 18, 1984 [JP] Japan ..... 59-147684

[51] Int. Cl.[4] ..... B41M 5/18

[52] U.S. Cl. ..... 346/209; 346/208; 346/216; 427/150; 427/151

[58] Field of Search ..... 347/208, 209; 427/150, 427/151, 152; 346/216, 225

[56] References Cited

FOREIGN PATENT DOCUMENTS 0182483 11/1982 Japan ..... 346/209

0182494 11/1982 Japan ..... 346/209

*Primary Examiner*—Bruce H. Hess

*Attorney, Agent, or Firm*—Sherman and Shalloway

[57] ABSTRACT

A thermosensitive recording sheet having a thermosensitive color developing layer containing a basic leuco dye and an organic color developer, said layer containing a polyphenyl ester compound of the general formula (I)

wherein $R^1$ and $R^2$, independently from each other, represent an alkyl group, a cycloalkyl group, or an aryl, aralkyl or aryloxyalkyl group which may have at least one substituent selected from the class consisting of halogen atoms, nitro groups, hydroxyl groups, lower alkyl groups and lower alkoxy groups.

8 Claims, No Drawings

THERMOSENSITIVE RECORDING SHEET

This invention relates to a thermosensitive recording sheet, and more specifically, to a thermosensitive recording sheet which has excellent resistance to soiling by oily substance such as hair-dressing agents or oils and fats and excellent image stability.

Generally, thermosensitive recording sheets are obtained by grinding a colorless to light-colored basic leuco dye and an organic color developer such as a phenolic substance into fine particles, mixing the particles of both, adding a binder, a filler, a sensitivity increasing agent, a lubricant and other auxiliary agents to form a coating composition, and applying the coating composition in a thin layer to a support such as paper or a plastic film. The thermosensitive color developing layer forms a color imagewise by an instantaneous chemical reaction induced by heating and thereby permits recording of the image. Images of various colors can be obtained by properly selecting the type of the leuco dye.

The thermosensitive recording sheets cannot avoid contact with human hands in view of their function as information recording media. Frequently, therefore, the fingers of persons who handle the sheet have adhering thereto oily substances such as half-dressing agents used in everyday lives or oils and fats contained in the sweat from the skin, and there are many occasions on which the thermosensitive recording sheets undergo soiling or contamination by these oily substances. Generally, the thermosensitive recording sheets do not have sufficient stability to these soiling substances, and the density of the color image may be reduced or lost at a part soiled by such substances. Furthermore, soiling of the background portion often results in discoloration.

Many substances are described in various literature references including Japanese Patent Publication No. 14039/1970 as color developers for thermosensitive recording sheets, but 4,4'-isopropylidene diphenol (bisphenol A) is now used most widely because of its stable quality, cost and availability. However, since bisphenol A has a high heat color-developing temperature, it cannot fully adapt to recording by a small amount of thermal energy, and troubles such as sticking tend to occur.

In an attempt to meet the recent requirements for higher recording speeds and higher image quality, Japanese Laid-Open Patent Publication No. 144193/1981 proposes a thermosensitive recording sheet including a p-hydroxybenzoic acid ester as a color developer used in combination with a fluoran-type dye, and makes it clear that higher sensitivity with excellent dynamic color developability can be easily achieved by this thermosensitive recording sheet. But the thermosensitive recording sheet containing the p-hydroxybenzoic acid ester as a color developing agent has the defect that the density of an image formed by application of heat decreases with time, the so-called "crystallization" phenomenon occurs whereby crystals precipitate onto the surface of the image, and that the image area does not have sufficient stability to oily substances.

Furthermore, on long-term storage, the recorded images may discolor or fade under external influences such as light, humidity and heat, and the background portion undergoes "backgrounding" whereby it is colored undesirably.

Japanese Laid-Open Patent Publication Nos. 45747/1974, 18752/1979 and 83495/1982 describe that phenolic antioxidants effectively act as stabilizers for improving the preservability of recorded images. The use of a large amount of such a stabilizer, however, tends to reduce the color developing sensitivity of the recording sheets because of its diluting effect.

Japanese Patent Publication No. 34310/1983 and Japanese Laid-Open Patent Publication No. 116690/1982 disclose the use of terephthalates or phthalates, such as diphenyl phthalate, di-(2-chlorophenyl)phthalate, di-(4-chlorophenyl)phthalate, di-(p-tolyl)phthalate, di-(4-nitrobenzyl)phthalate, di-(2,4,5-trimethylphenyl)phthalate, di-(5-methyl-2-isopropylphenyl)phthalate and diphenyl terephthalate, as additives for improving the heat resistance, water resistance, thermosensitive properties (sensitivity) and head matching of thermosensitive color developing layer of thermosensitive recording sheets. These compounds, however, do not prove to be sufficiently effective for storage stability and soiling resistance the improvement of which is contemplated by the present invention (see Comparative Examples given hereinafter).

It is an object of this invention to provide a thermosensitive recording sheet capable of giving a clear and stable color image having a sufficiently high dynamic image density and excellent resistance to soiling substances such as hair-dressing agents or oils and fats.

Another object of this invention is to provide a thermosensitive recording sheet which can form a clear and stable dye image having a sufficiently high dynamic image density and excellent long-term preservability and undergoing little discoloration and fading by moisture, heat, etc., and which is free from backgrounding and has excellent resistance to soiling substances such as hair-dressing agents or oils and fats.

Further objects and advantages of this invention will become apparent from the following description.

According to this invention, there is provided a thermosensitive recording sheet having a thermosensitive color developing layer containing a basic leuco dye and an organic color developer, said layer containing a polyphenyl ester compound of the general formula

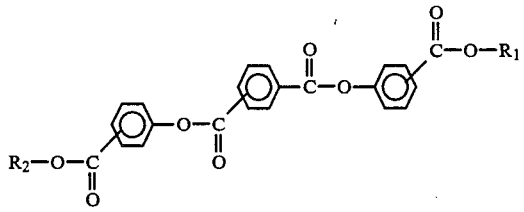

(I)

wherein $R^1$ and $R^2$, independently from each other, represent an alkyl group, a cycloalkyl group, or an aryl, aralkyl or aryloxyalkyl group which may have at least one substituent selected from the class consisting of halogen atoms, nitro groups, hydroxyl groups, lower alkyl groups and lower alkoxy groups.

The term "lower", as used herein to qualify a group or compound, means that the group or compound so qualified has not more than 5 carbon atoms.

The "alkyl group" in general formula (I) may be linear or branched, and includes, for example, methyl, ethyl, n-propyl, isopropyl, n-butyl, isobutyl, sec-butyl, tert-butyl, n-pentyl, isopentyl, n-hexyl, n-octyl, 2-ethylhexyl, isooctyl, nonyl and dodecyl groups. The "cycloalkyl groups" may have an alkyl group on the cycloaliphatic ring, and includes, for example, cyclopentyl, cyclohexyl, cycloheptyl, o-ethylcyclohexyl, and p-tert-butylcyclohexyl groups.

Examples of the "aryl group" are phenyl and alpha- or beta-naphthyl groups. The "aralkyl group" means an aryl-alkyl group, and particularly includes phenyl-lower alkyl groups such as benzyl, phenethyl, phenylpropyl and phenylbutyl groups. The "aryloxyalkyl group" includes phenyl-O-lower alkyl groups such as phenoxymethyl, phenoxyethyl, phenoxypropyl and phenoxybutyl groups. The aromatic ring (aryl moiety) in the "aryl group", "aralkyl group" and "aryloxyalkyl group" is unsubstituted, or may be substituted by at least one (preferably 1 to 3) substituent selected from halogen atoms such as fluorine, chlorine and bromine atoms, hydroxyl groups, lower alkyl groups such as methyl, ethyl, n-propyl, isopropyl, n-butyl, sec-butyl and tert-butyl groups, and lower alkoxy groups such as methoxy, ethoxy, n-propoxy, isopropoxy, n-butoxy, sec-butoxy and tert-butoxy groups.

Examples of preferred groups $R_1$ and $R_2$ in general formula (I) include alkyl groups having 1 to 12 carbon atoms, cycloalkyl groups having 3 to 10, particularly 5 to 6 carbon atoms, and groups of the following formulae

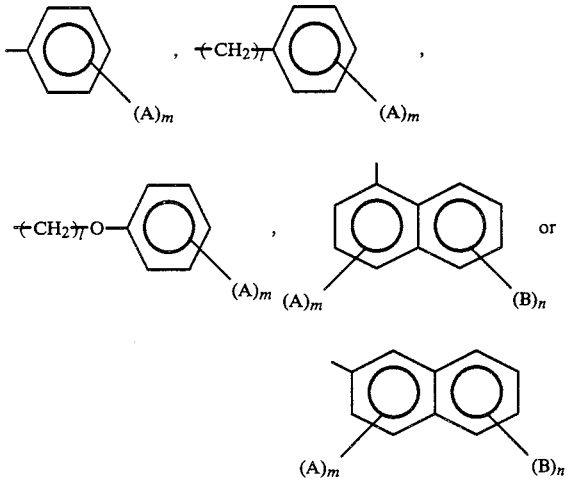

wherein A and B, independently from each other, represent a halogen atom, a nitro group, a hydroxyl group, a lower alkyl group or a lower alkoxy group, l is an integer of 1 to 5, and m and n are 0 or an integer of 1 to 3, provided that when m and n are 2 or 3, two or three groups A or B may be identical or different.

Especially preferred groups $R_1$ and $R_2$ are alkyl groups having 1 to 12 carbon atoms, especially lower alkyl groups, a cyclohexyl group, a benzyl group, a phenethyl group, or a phenoxymethyl group.

The polyphenyl ester compounds of formula (I) above have a unique function as stabilizers for the thermosensitive color developing layer of thermosensitive recording sheets, and the thermosensitive recording sheets containing such compounds exhibit the following advantages.

(1) The color images developed are stable even when hair-dressing agents or oils and fats adhere to them.

(2) As can be clearly been from the results of a heat resistance test (60° C., dry, 24 hours) and a moisture resistance test (40° C., 90% RH, 24 hours) given in Examples hereinafter, they have excellent heat resistance and moisture resistance, and the recorded images and background color have good long-term storage stability.

(3) When used in combination with benzyl 4-hydroxybenzoate as a color developing agent, these polyphenyl ester compounds can prevent the crystallization phenomenon inherent to this color developing agent.

In view of stabilizing ability, the availability of materials for synthesis, the ease of synthesis, and cost, preferred species of the polyphenyl ester compounds of general formula (I) are those of the following formula

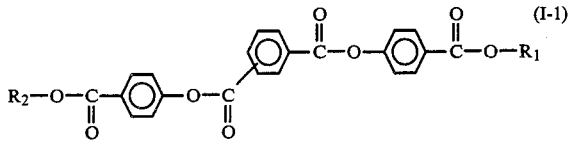

(I-1)

wherein $R_1$ and $R_2$ are as defined above.

More preferred compounds are those of general formula (I-1) in which R is an alkyl group having 1 to 12 carbon atoms, preferably 1 to 5 carbon atoms, a cyclohexyl group, a benzyl group, a phenethyl group or a phenoxymethyl group in view of their melting range, sublimability and molecular weight and the sensitivity (thermal response) and oil resistance of a thermosensitive recording sheet containing such a compound.

Typical examples of the polyphenyl ester compounds of formula (I) or (I-1) used in this invention are shown below without any intention of limiting the invention thereto.

(1)

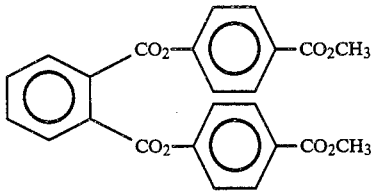

(2)

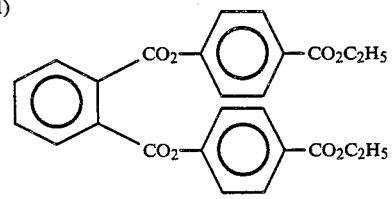

-continued
(3)
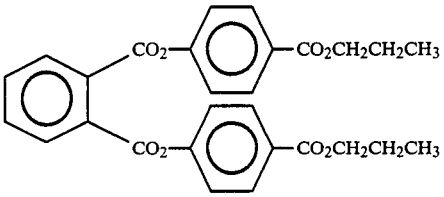
(4)
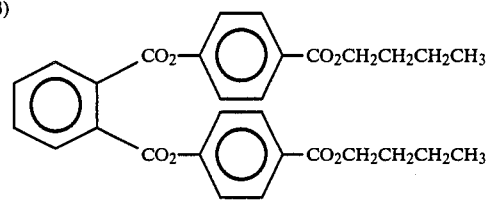
(5)
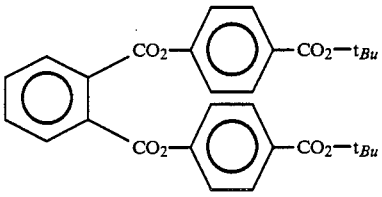
(6)
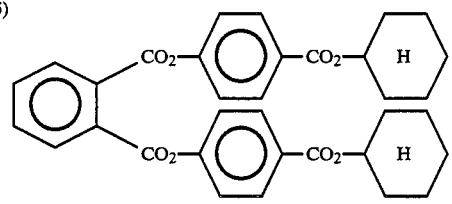
(7)
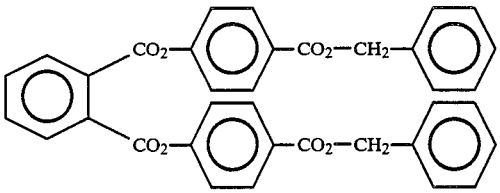
(8)
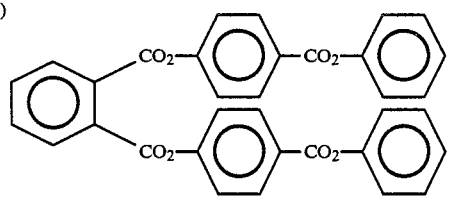
(9)
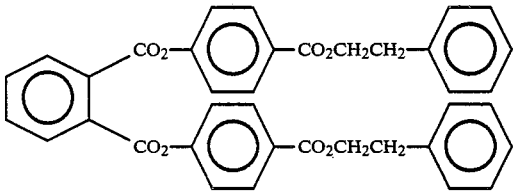
(10)
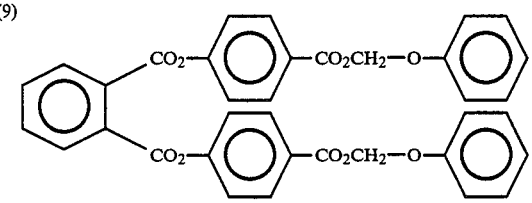
(11)
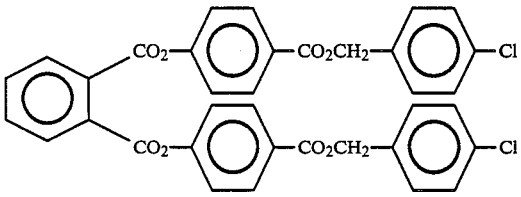
(12)
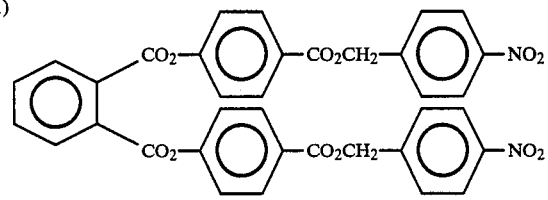
(13)
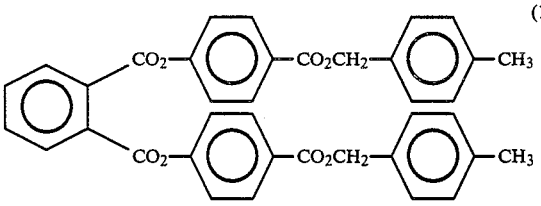
(14)
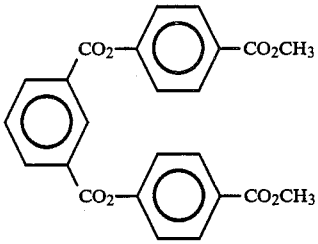
(15)
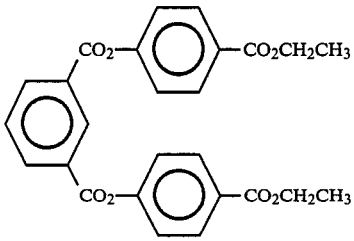
(16)
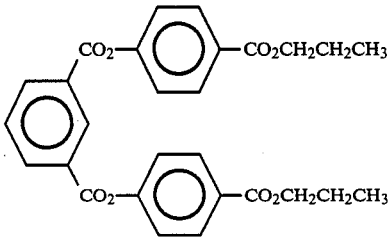

-continued
(17)
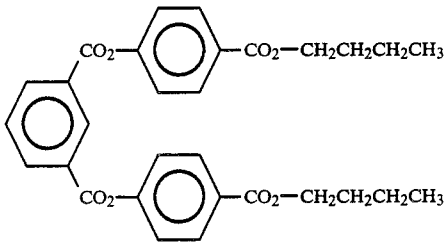
(18)
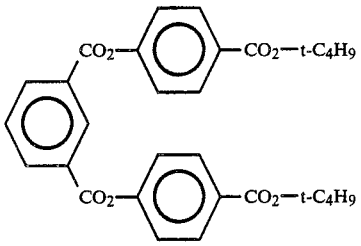
(19)
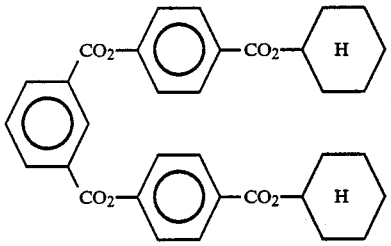
(20)
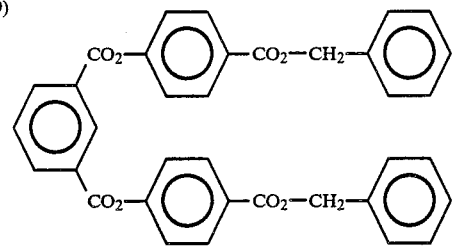
(21)
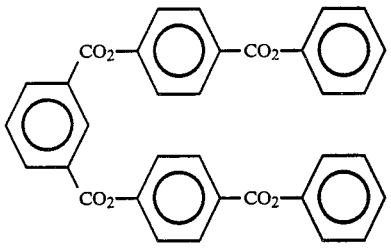
(22)
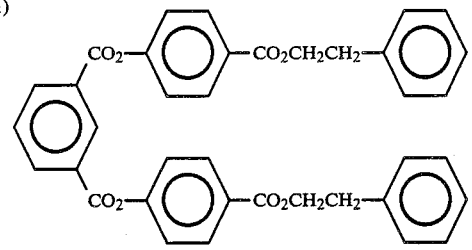
(23)
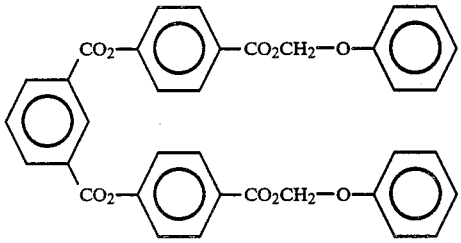
(24)
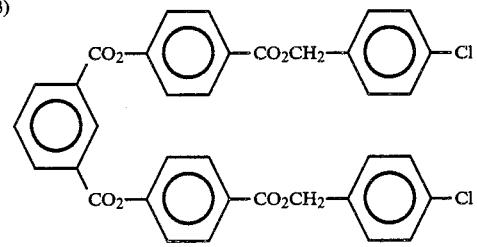
(25)
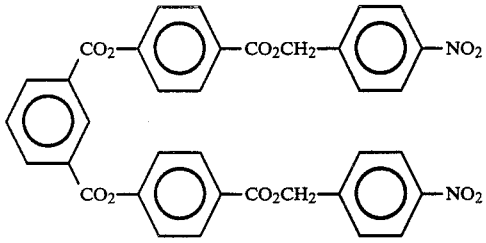
(26)
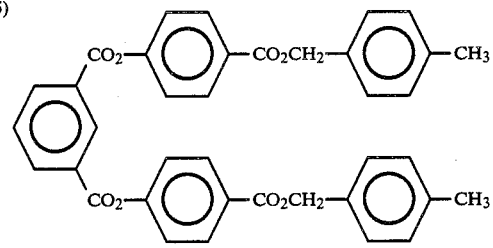
(27)
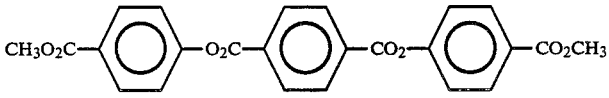
(28)
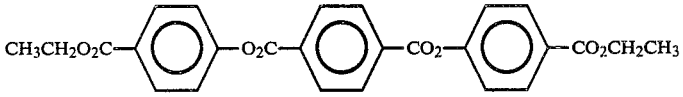
(29)
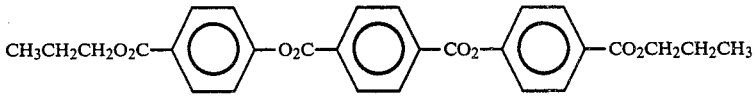

-continued (30)

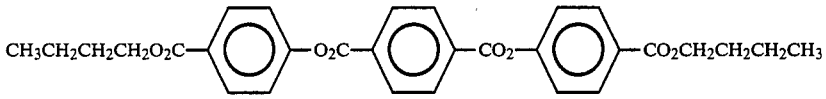

(31)

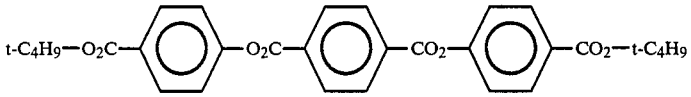

(32)

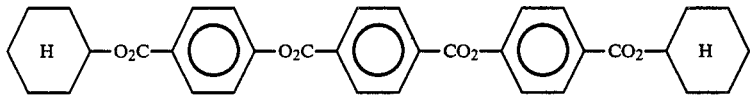

(33)

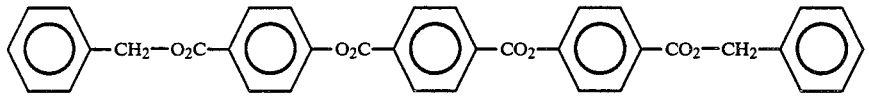

(34)

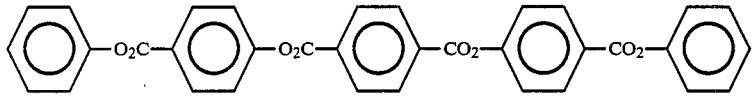

(35)

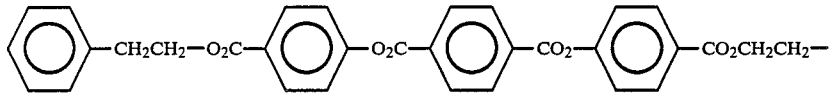

(36)

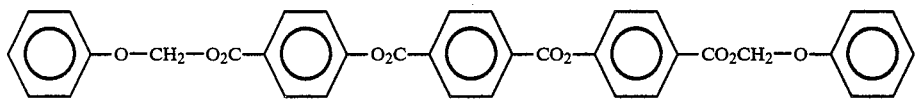

(37)

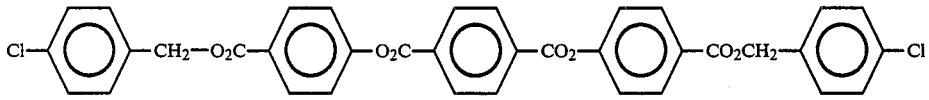

(38)

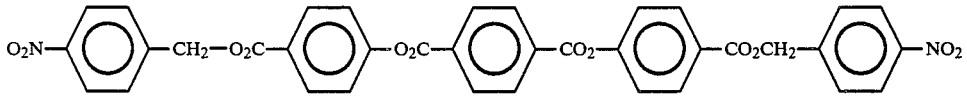

(39)

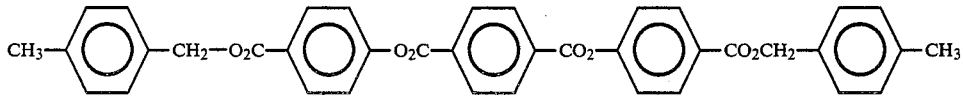

The compounds of formula (I) may be used singly or in combination with each other.

When the melting point range, sublimability, molecular weight and oil resistance of these polyphenyl ester compounds are comprehensively considered from a viewpoint of using them as stabilizers, compounds of the following formula (I-2) and (I-3) are most preferred.

(I-2)

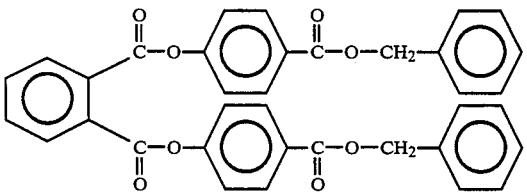

-continued (I-3)

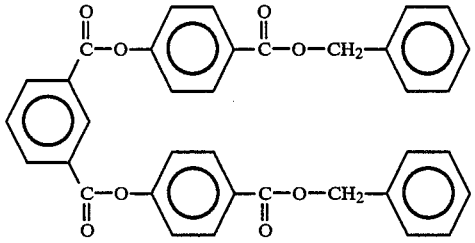

The effects of the present invention are most remarkable when benzyl 4-hydroxybenzene is used as a color developing agent and the compound of formula (I-2) or (I-3) is used as a stabilizer. The compound of formula (I-2) or (I-3) has four ester groups and five benzene rings, and three benzene rings and four ester groups are linked to each other alternately. Thus, the

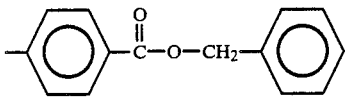

in the molecule has a similar structure to

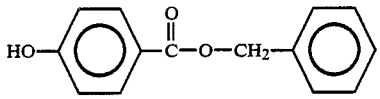

in the benzyl 4-hydroxybenzoate molecule. Presumably, some specific intermolecular action occurs between them and contributes to the marked advantage of the invention.

Examples of the organic color developers that can be used in the thermosensitive color developing layer in accordance with this invention include bisphenol A compounds, 4-hydroxybenzoic acid esters, 4-hydroxyphthalic acid diesters, phthalic acid monoesters, bis(-hydroxyphenyl)sulfides, 4-hydroxyphenylarylsulfones, 4-hydroxyphenylarylsulfonates, 1,3-di[2-(hydroxyphenyl)-2-propyl]benzenes, and other color developers. Specific examples are given below:

bis-Phenol A compounds 4,4'-isopropylidene diphenol (also called bisphenol A),
4,4'-cyclohexylidene diphenol, and
p,p'-(1-methyl-n-hexylidene)diphenol.

4-Hydroxybenzoates

Benzyl 4-hydroxybenzoate,
ethyl 4-hydroxybenzoate,
propyl 4-hydroxybenzoate,
isopropyl 4-hydroxybenzoate,
butyl 4-hydroxybenzoate,
isobutyl 4-hydroxybenzoate, and
methylbenzyl 4-hydroxybenzoate.

4-Hydroxyphthalic acid diesters

Dimethyl 4-hydroxyphthalate,
diisopropyl 4-hydroxyphthalate,
dibenzyl 4-hydroxyphthalate, and
dihexyl 4-hydroxyphthalate.
Phthalic acid monoesters
Monobenzyl phthalate,
monocyclohexyl phthalate,
monophenyl phthalate,
monomethylphenyl phthalate,
monoethylphenyl phthalate,
monoalkylbenzyl phthalates,
monohalobenzyl phthalates, and
monoalkoxybenzyl phthalates.

bis-(Hydroxyphenyl)sulfides bis-(4-Hydroxy-3-tert-butyl-6-methylphenyl)sulfide,
bis(4-hydroxy-2,5-dimethylphenyl)sulfide,
bis-(4-hydroxy-2-methyl-5-ethylphenyl)sulfide,
bis-(4-hydroxy-2-methyl-5-isopropylphenyl)sulfide,
bis-(4-hydroxy-2,3-dimethylphenyl)sulfide,
bis-(4-hydroxy-2,5-diethylphenyl)sulfide,
bis-(4-hydroxy-2,5-diisopropylphenyl)sulfide,
bis-(4-hydroxy-2,3,6-trimethylphenyl)sulfide,
bis-(2,4,5-trihydroxyphenyl)sulfide,
bis-(4-hydroxy-2-cyclohexyl-5-methylphenyl)sulfide,
bis-(2,3,4-trihydroxyphenyl)sulfide,
bis-(4,5-dihydroxy-2-tert-butylphenyl)sulfide,
bis-(4-hydroxy-2,5-diphenylphenyl)sulfide, and
bis(4-hydroxy-2-tert-octyl-5-methylphenyl)sulfide.

4-Hydroxyphenyl arylsulfones

4-Hydroxy-4'-isopropoxydiphenylsulfone,
4-hydroxy-4'-methyldiphenylsulfone, and
4-hydroxy-4'-n-butyloxydiphenylsulfone.

4-Hydroxyphenyl arylsulfonates

4-Hydroxyphenyl benzenesulfonate,
4-hydroxyphenyl p-tolyllsulfonate,
4-hydroxyphenyl mesitylenesulfonate,
4-hydroxyphenyl p-chlorobenzenesulfonate,
4-hydroxyphenyl p-tert-butylbenzenesulfonate,
4-hydroxyphenyl p-isopropoxybenzenesulfonate,
4-hydroxyphenyl 1'-naphthalenesulfonate, and
4-hydroxyphenyl 2'-naphthalenesulfonate.

1,3-Di[2-(hydroxyphenyl)-2-propyl]benzenes 1,3-Di[2-(4-hydroxyphenyl)-2-propyl]benzene,
1,3-di[2-(4-hydroxy-3-alkylphenyl)-2-propyl]benzene,
1,3-di[2-(2,4-dihydroxyphenyl)-2-propyl]benzene, and
1,3-di[2-(2-hydroxy-5-methylphenyl)-2-propyl]benzene.

Resorcinols 1,3-Dihydroxy-6(alpha,alpha-dimethylbenzyl)benzene.

Others p-tert-Butylphenol,
2,4-dihydroxybenzophenone,
novolak-type phenolic resins,
4-hydroxyacetophenone,
p-phenylphenol,
benzyl-4-hydroxyphenylacetate, and
p-benzylphenol.

These color developers may be used singly or in combination.

Other organic color developers which can be used, include benzyl 4-hydroxybenzoate, 4-hydroxyphenyl 2'-naphthalenesulfonate, 1,3-di[2-(4-hydroxyphenyl)-2-propyl]benzene, 1,3-dihydroxy-6(alpha,alpha-dimethylbenzyl)benzene and 4-hydroxy-4'-isopropoxydiphenylsulfone.

As suggested in the above-cited Japanese Laid-Open Patent Publication No. 144193/1981, benzyl 4-hydroxybenzoate can give a thermosensitive recording sheet of high sensitivity and excellent dynamic color developability when combined with a fluorane-type dye. But a thermosensitive recording sheet containing this color developer has the defect that the density of an image formed by application of heat is reduced with time or undergoes the "crystallization" phenomenon, and the image area does not have sufficient stability to oily substances. It has been found, however, that by using the polyphenyl ester compound of formula (I) together, the stability of the image is greatly increased.

The "basic leuco dye" used in the thermosensitive recording sheet of this invention is a basic dye having the property of being normally colorless or light-colored but upon contact with the aforesaid color developers under heat, forming a color. There is no particular restriction on the basic leuco dye used in this invention and any basic leuco dyes heretofore used in thermosensitive recording sheets can equally be used. Generally, leuco dyes of the triphenylmethane, fluoran and azaphthalide types are preferred. Specific examples are shown below:

Triphenylmethane-type leuco dyes 3,3-bis(p-Dimethylaminophenyl)-6-dimethylaminophthalide (also called Crystal Violet Lactone).

Fluoran-type leuco dyes

3-Diethylamino-6-methyl-7-anilinofluoran,
3-(N-ethyl-p-toluidino)-6-methyl-7-anilinofluoran,
3-(N-ethyl-N-isoamyl)amino-6-methyl-7-anilinofluoran,
3-diethylamino-6-methyl-7-(o,p-dimethylanilino)fluoran,
3-pyrrolidino-6-methyl-7-anilinofluoran,
3-piperidino-6-methyl-7-anilinofluoran,
3-(N-cyclohexyl-N-methylamino)-6-methyl-7-anilinofluoran,
3-diethylamino-7-(m-trifluoromethylanilino)fluoran,
3-dibutylamino-7-(o-chloroanilino)fluoran,
3-diethylamino-6-methyl-chlorofluoran,
3-diethylamino-6-methyl-fluoran,
3-cyclohexylamino-6-chlorofluoran,
3-diethylamino-7-(o-chloroanilino)fluoran, and 3-diethylamino-benzo[a]-fluoran.

Azaphthalide-type leuco dyes 3-(4-Diethylamino-2-ethoxyphenyl-3-(1-ethyl-2-methylindol-3-yl)-4-azaphthalide,
3-(4-diethylamino-2-ethoxyphenyl)-3-(1-ethyl-2-methylindol-3-yl)-7-azaphthalide,
3-(4-diethylamino-2-ethoxyphenyl)-3-(1-octyl-2-methylindol-3-yl)-4-azaphthalide, and
3-(4-N-cyclohexyl-N-methylamino-2-methoxyphenyl)-3-(1-ethyl-2-methylindol-3-yl)-4-azaphthalide.

These dyes may also be used singly or in combination. In the present invention, a thermosensitive recording sheet having a markedly high dynamic color developing density can be obtained by using 3-diethylamino-6-methyl-7-anilinofluoran, 3-(N-cyclohexyl-N-methylamino)-6-methyl-7-anilinofluoran, 3-(N-ethyl-N-isoamyl)amino-6-methyl-7-anilinofluoran and 3-(4-diethylamino-2-ethoxyphenyl)-3-(1-ethyl-2-methylindol-3-yl)-4-azaphthalide singly as the basic leuco dye.

A thermosensitive recording sheet having excellent oil resistance and storage stability and a high dynamic image density can be obtained when a mixture of 3-diethylamino-6-methyl-7-anilinofluoran and 3-(N-cyclohexyl-N-methylamino)-6-methyl-7-anilinofluoran is used as the basic leuco dye.

The amounts and proportions of the polyphenyl ester compound of formula (I), the organic color developer and the basic leuco dye are not critical, and can be varied over wide ranges depending upon the performance or recording adaptability of the resulting product. Generally, the polyphenyl ester compound of formula (I) is used in an amount of 0.1 to 10 parts by weight, preferably 0.5 to 5 parts by weight, per part by weight of the basic leuco dye. Conveniently, the organic color developer is used in an amount of 1 to 6 parts by weight, preferably 2 to 5 parts by weight, per part by weight of the basic leuco dye.

The polyphenyl ester compound of formula (I), the color developer and the basic leuco dye are reduced to fine particles having a particle diameter of less than several microns by a grinding machine such as a ball mill, an attriter or a sand grinder, or a suitable emulsifying device, and according to the purpose for which the final product is used, various additives are added. The resulting coating composition is coated on a substrate such as paper or a plastic film, and dried to form a thermosensitive recording layer whose amount of coating may be 4 to 10 g/m$^2$ (in a dry condition). As a result, the thermosensitive recording sheet of this invention can be obtained.

The additives which can be blended with the polyphenyl ester compound, the color developer and the basic leuco dye may be those which are used in conventional thermosensitive recording sheets. Examples include binders such as polyvinyl alcohol, modified polyvinyl alcohol, hydroxyethyl cellulose, methyl cellulose, starches, a styrene/maleic anhydride copolymer, a vinyl acetate/maleic anhydride copolymer and a styrene/butadiene copolymer; inorganic or organic fillers such as kaolin, calcined kaolin, diatomaceous earth, talc, titanium oxide and aluminum hydroxide; mold releasing agents such as fatty acid metal salts; lubricants such as waxes; ultraviolet absorbers such as benzophenone compounds and triazole compounds; waterproofing agents such as glyoxal; dispersing agents such as sodium hexametaphosphate and sodium polycarboxylates; defoamers such as acetylene glycol; pressure fog preventing agents such as fatty acid amides, ethylenebisamide, montan wax and polyethylene wax; sensitizers such as dibenzyl terephthalate, benzyl p-benzyloxybenzoate, di-p-tolyl carbonate and p-benzylbiphenyl; and stabilizers such as phthalic acid monoester metal salts, p-tertiary butylbenzoic acid metal salts and nitrobenzoic acid metal salts. The amounts of these additives are determined depending upon the properties required of the product, its recording suitability, etc., and are not particularly restricted. As tentative standards, they are, for example, 10 to 25% by weight based on the total solids for the binders, and 1 to 20 parts by weight per part by weight of the leuco dye for the fillers. The other components may be used in amounts normally used.

The characteristics and advantages of the thermosensitive recording sheet of this invention are as follows:

(1) It has resistance to the adhesion of soiling substances such as hair-dressing agents and oils and fats, and therefore gives images of good stability (good soiling resistance).
(2) Images recorded on it have excellent storage stability. Particularly, the recorded images do not fade under moisture and heat, and do not undergo backgrounding.
(3) The compound of formula (I) markedly increases the storage stability of images formed by thermosensitive recording, and does not cause coloraiton of the coating composition nor backgrounding of the thermosensitively colored layer.
(4) Even when benzyl 4-hydroxybenzoate is used as the color developing agent, the crystallization phenomenon inherent to it can be prevented.

At least some of the compounds of formula (I) are novel, and may be prepared in accordance with a known esterification method, for example, by reacting a compound of the formula

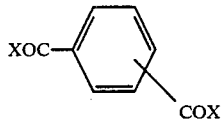

(II)

wherein X is halogen, e.g., chlorine or bromine, with at least one compound of the formula

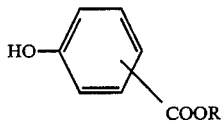

(III)

wherein R is the same as $R_1$ or $R_2$, in a suitable solvent such as toluene, benzene, oxylene, in the presence of an amine such as triethylamine, pyridine, or dimethylaniline.

Reference Example

A 500 ml. four-necked flask equipped with a condenser tube and a thermometer are charged with 56 g of benzyl p-hydroxybenzoate, 25 g of triethylamine and 60 ml of toluene. A suspension of 25 g of terephthalic dichloride in 100 ml of toluene is added dropwise over 3 hours with stirring while maintaining the mixture at 0°-5° C. After the addition, the mixture is further allowed to react at 0°-5° C. for hour. Therefore the reaction product is collected by filtration to obtain while crystals. The crystals are washed twice with 1500 ml of water and then twice with 1000 ml of methanol and subsequently, recrystallized from chloroform to give di(p-benzyloxycarbonylphenyl)terephthalate melting at 186°-187° C. as white crystals.

The following compounds can be prepared in a manner similar to that shown in the above Reference Example:

Di(p-benzyloxycarbonylphenyl)isophthalate, m.p. 105°-107° C.

Di(p-benzyloxycarbonylphenyl)phthalate, m.p. 100°-103° C.

Di(p-methoxycarbonylphenyl)phthalate, m.p. 123°-125° C.

Di(p-methoxycarbonylphenyl)isophthalate, m.p. 215°-217° C.

Di(p-methoxycarbonylphenyl)terephthalate, m.p. 243°-245° C.

Di(p-ethoxycarbonylphenyl)isophthalate, m.p. 123°-125° C.

Di(p-ethoxycarbonylphenyl)terephthalate, m.p. 187°-189° C.

Di(p-propoxycarbonylphenyl)phthalate, m.p. 87°-89° C.

Di(p-propoxycarbonylphenyl)terephthalate, m.p. 136°-139° C.

Di(p-butoxycarbonylphenyl)terephthalate, m.p. 128°-131° C.

Di(p-octyloxycarbonylphenyl)terephthalate, m.p. 108°-110° C.

The following Examples and Comparative Examples typically illustrate the present invention more specifically.

All parts and percentages in these examples are by weight.

EXAMPLES 1-2 AND COMPARATIVE EXAMPLES 1-7

| | |
|---|---|
| Dispersion A | |
| 2-Diethylamino-6-methyl-7-anilino-fluoran | 2.0 parts |
| 10% Aqueous solution of polyvinyl alcohol | 4.6 parts |
| Water | 2.5 parts |
| Dispersion B | |
| Benzyl 4-hydroxybenzoate | 5.0 parts |
| Zinc stearate | 1 part |
| 10% Aqueous solution of polyvinyl alcohol | 29.5 parts |
| Water | 5.5 parts |
| Dispersion C | |
| Stabilizer (see Table 1 below) | 2.0 parts |
| 10% Aqueous solution of polyvinyl alcohol | 5.0 parts |
| Water | 3.0 parts |

In each run, the dispersions A, B and C of the above compositions were each ground to a particle diameter of 3 microns in a ball mill.

Thereafter, 9.1 parts of dispersion A (leuco dye dispersion), 41.0 parts of dispersion B (color developer dispersion), 10 parts of dispersion C (stabilizer dispersion), and 20 parts of a 50% dispersion of kaolin clay were mixed to form a coating dispersion. The dispersion was coated on one surface of a substrate paper (basis weight 50 g/m$^2$) at a rate of 6.0 g/m$^2$, and dried. The sheet was then treated with a supercalender so that its degree of smoothness became 200 to 600 seconds. The resulting thermosensitive recording sheet adapted for developing a black color was tested for properties, and the results are shown in Table 1.

Dispersion C was not used in Comparative Example 1.

TABLE 1

| | | Stabilizer | Image density (*1) Static (*2) | Image density (*1) Dynamic (*3) | Stability of background (*4) Untreated | Stability of background (*4) Moisture resistance (*5) | Stability of background (*4) Heat resistance (*6) | Record preservability (*7) Untreated | Record preservability (*7) Moisture resistance (*8) | Record preservability (*7) Heat resistance (*9) | Oil resistance (*10) Untreated | Oil resistance (*10) After oil treatment | Oil resistance (*10) Residual ratio (%) (*11) | Crystallization on image surface (*12) |
|---|---|---|---|---|---|---|---|---|---|---|---|---|---|---|
| Example | 1 | 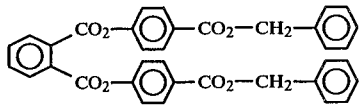 | 1.37 | 1.28 | 0.04 | 0.04 | 0.14 | 1.28 | 1.30 | 1.35 | 1.28 | 1.17 | 91 | O |
| | 2 | 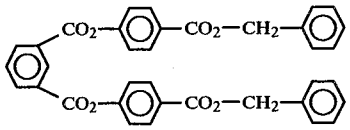 | 1.35 | 1.27 | 0.04 | 0.04 | 0.14 | 1.27 | 1.29 | 1.33 | 1.27 | 1.14 | 90 | O |
| Comparative | 1 | None | 1.40 | 1.28 | 0.04 | 0.06 | 0.14 | 1.28 | 0.99 | 1.33 | 1.28 | 0.43 | 34 | X |
| Example | 2 | 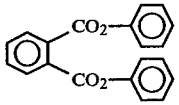 | 1.37 | 1.21 | 0.05 | 0.06 | 0.19 | 1.21 | 1.01 | 1.15 | 1.21 | 0.42 | 35 | X |
| | 3 | 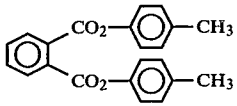 | 1.35 | 1.22 | 0.05 | 0.07 | 0.18 | 1.22 | 1.02 | 1.09 | 1.22 | 0.45 | 37 | X |
| | 4 | 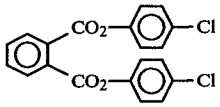 | 1.34 | 1.21 | 0.05 | 0.07 | 0.20 | 1.21 | 1.00 | 1.10 | 1.21 | 0.47 | 39 | X |
| | 5 | 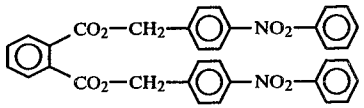 | 1.35 | 1.20 | 0.04 | 0.07 | 0.19 | 1.20 | 1.02 | 1.11 | 1.20 | 0.38 | 32 | X |

TABLE 1-continued

| | Stabilizer | Image density (*1) Static (*2) | Image density (*1) Dynamic (*3) | Stability of background (*4) Untreated | Stability of background (*4) Moisture resistance (*5) | Stability of background (*4) Heat resistance (*6) | Record preservability (*7) Untreated | Record preservability (*7) Moisture resistance (*8) | Record preservability (*7) Heat resistance (*9) | Oil resistance (*10) Untreated | Oil resistance (*10) After oil treatment | Oil resistance (*10) Residual ratio (%) (*11) | Crystallization on image surface (*12) |
|---|---|---|---|---|---|---|---|---|---|---|---|---|---|
| 6 | 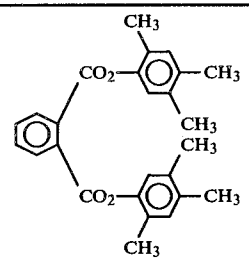 | 1.36 | 1.22 | 0.05 | 0.06 | 0.22 | 1.22 | 1.01 | 1.10 | 1.22 | 0.39 | 32 | X |
| 7 | 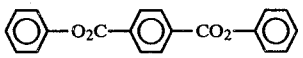 | 1.37 | 1.21 | 0.04 | 0.07 | 0.21 | 1.21 | 1.00 | 1.12 | 1.21 | 0.37 | 31 | X |

O: Hardly any crystallization was observed.
X: Considerable crystallization was observed.
(*1): Image density Measured by a Macbeth densitometer (RD-514 with an amber filter: the Macbeth densitometers mentioned hereinafter are the same as this one).
(2*): Static image density The recording sheet was pressed against a hot plate heated at 105° C. under a pressure of 10 g/cm$^2$ for 5 seconds, and the density of the formed color was measured by the Macbeth densitometer.
(3*): Dynamic image density The density of an image recorded on the thermosensitive recording sheet by a thermosensitive facsimile (Cp-4800A made by Tokyo Shibaura Electric Co., Ltd.) with a pulse width of 0.7 millisecond in GIII mode was measured by the Macbeth densitometer.
(4*): Stability of the background The optical density of an uncolored portion of the recording sheet was measured by the Macbeth densitometer.
(5*): Moisture resistance The recording sheet was left to stand at 40° C. and 90% RH for 24 hours, and the optical density of its background was measured.
(6*): Heat resistance The recording sheet was left to stand under a drying conditions at 60° C. for 24 hours, and the optical density of its background was measured.
(7*): Record preservability: In accordance with the method (*3) above.
(8*): Moisture resistance: The image density after standing for 24 hours at 40° C. and 90% RH.
(9*): Heat resistance: The image density after standing for 24 hours at 60° C. in a dry condition.
(10*): Oil resistance A droplet (0.8 mg) of castor oil dropped onto a glass plate by an injection syringe was spread to an area of 40 cm$^2$. Then, by using a rubber stamp (1 cm × 1.5 cm), the oil was transferred to that surface of the recording sheet which developed a color in accordance with the procedure described in (*7) above. After standing at 40° C. and 90% RH for 24 hours, the density of the color in the transferred portion was measured by the Macbeth densitometer.

Residual ratio of image density Calculated in accordance with the following equation. $\text{Residual ratio} = \frac{\text{Image density after oil treatment}}{\text{Image density of the untreated sample}} \times 100\ (\%)$ (12*): Cyrtallization on the image surface The thermosensitive recording sheet dynamically colored by the method described in (*7) was stored in a file for one month at room temperature. The degree of formation of crystals on the colored image surface was determined by visual observation.

The results given in Table 1 demonstrate that the thermosensitive recording sheets of this invention containing the polyphenyl ester compound of formula (I) (Examples 1 and 2) have much better heat resistance and moisture resistance in the background, better moisture resistance and heat resistance in the record sheets, and much better oil resistance than recording sheets containing no such compound (Comparative Example 1) or containing the known phthalate or terephthalate derivatives (Comparative Examples 2 to 7).

What we claim is:

1. A thermosensitive recording sheet having a thermosensitive color developing layer containing a basic leuco dye and an organic color developer, said layer containing a polyphenyl ester compound of the general formula

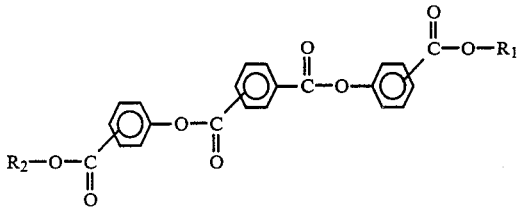

(I)

wherein $R^1$ and $R^2$, independently from each other, represent an alkyl group, a cycloalkyl group, or an aryl, aralkyl or aryloxyalkyl group which may have at least one substituent selected from the class consisting of halogen atoms, nitro groups, hydroxyl groups, lower alkyl groups and lower alkoxy groups.

2. The thermosetting recording sheet of claim 1 wherein R1 and R2, independently from each other, represent an alkyl group having 1 to 12 carbon atoms, a cycloalkyl group having 3 to 10 carbon atoms, or a group of the following formula

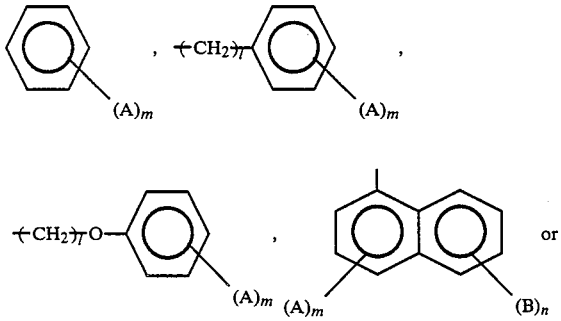

-continued

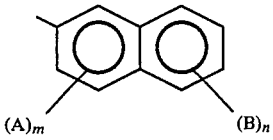

wherein A and B, independently from each other, represents a halogen atom, a nitro group, a hydroxyl group, a lower alkyl group or a lower alkoxy group, l is an integer of 1 to 5, and m and n are each 0 or an integer of 1 to 3, provided that when m and n are 2 or 3, two or three groups A or B may be identical or different.

3. The thermosensitive recording material of claim 1 wherein the polyphenyl ester compound is represented by the following general formula

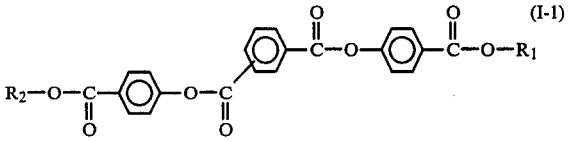

(I-1)

wherein $R_1$ and $R_2$ are as defined above.

4. The thermosensitive recording sheet of claim 3 wherein R represents an alkyl group having 1 to 12 carbon atoms, a cyclohexyl group, a benzyl group, a phenethyl group, or a phenoxymethyl group.

5. The thermosensitive recording sheet of claim 3 wherein the polyphenyl ester compound is a compound of the formula (I-2) or (I-3):

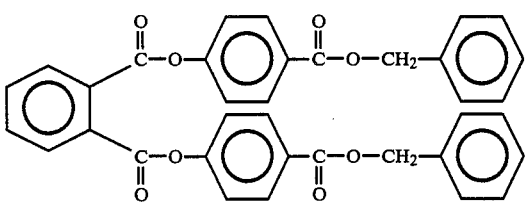

(I-2)

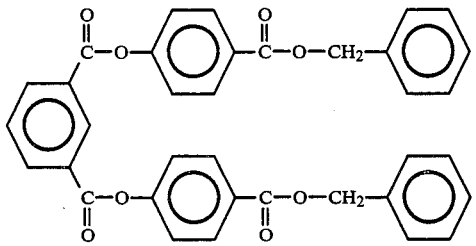

(I-3)

6. The thermosensitive recording sheet of claim 5 wherein the organic color developer is a benzyl 4-hydroxybenzoate.

7. The thermosensitive recording sheet of claim 1 wherein the layer contains 0.1 to 10 parts by weight, per 1 part by weight of the basic leuco dye, of the polyphenyl ester compound.

8. The thermosensitive recording sheet of claim 1 wherein the organic color developer is a benzyl 4-hydroxybenzoate.

* * * * *